United States Patent [19]

Hertz et al.

[11] 4,046,979

[45] Sept. 6, 1977

[54] ARC QUENCHING ARRANGEMENT FOR A GAS-FLOW TYPE CIRCUIT BREAKER

[75] Inventors: Walter Hertz; Jan Stroh; Jürgen Mentel, all of Erlangen, Germany

[73] Assignee: Siemens Aktiengesellschaft, Munich, Germany

[21] Appl. No.: 632,991

[22] Filed: Nov. 18, 1975

[30] Foreign Application Priority Data

Nov. 25, 1974 Germany ..... 2455674

[51] Int. Cl.[2] ..... H01H 33/70

[52] U.S. Cl. ..... 200/148 A; 200/150 G

[58] Field of Search ..... 200/148 A, 148, 150 G

[56] References Cited

U.S. PATENT DOCUMENTS

| | | | |
|---|---|---|---|
| 3,940,583 | 2/1976 | Hertz | 200/148 A |
| 3,946,180 | 3/1976 | Votta et al. | 200/148 A |
| 3,975,602 | 8/1976 | Hertz et al. | 200/148 A |

FOREIGN PATENT DOCUMENTS

| | | | |
|---|---|---|---|
| 2,411,897 | 9/1975 | Germany | 200/148 A |

*Primary Examiner*—Robert S. Macon

*Attorney, Agent, or Firm*—Kenyon & Kenyon, Reilly, Carr & Chapin

[57] ABSTRACT

An improved arc quenching arrangement for a gas-flow circuit breaker apparatus of the type including a housing; a body of electrical insulation material disposed within the housing and forming an arc quenching gap therewithin; at least one gas flow canal disposed within the body of insulation material for directing a quenching gas from a space within the housing to the vicinity of the quenching gap; fixed and movable electrical contacts disposed within the housing adjacent the housing quenching gap; and a check valve disposed in the flow canal for permitting the flow of the arc quenching gas only from the space within the housing to the quenching gap formed by the body of insulation material. The improvement of the invention comprises the extension of the gas flow canal to the arc quenching gap formed by the body of insulation material and the disposition of the check valve at the end of the flow canal at the arc quenching gap. An improved arc quenching effect for large current flow is thereby achieved.

11 Claims, 2 Drawing Figures

ARC QUENCHING ARRANGEMENT FOR A GAS-FLOW TYPE CIRCUIT BREAKER

BACKGROUND OF THE INVENTION

1. Field of the Invention

This invention relates generally to gas-flow type circuit breakers, and in particular to an improved arc-quenching arrangement for such circuit breakers, particularly blast piston ("buffer") circuit breakers.

2. Description of the Prior Art

Arc-quenching arrangements for gas-flow type circuit breakers including flow canals for directing an arc-quenching gas to the vicinity of a quenching gap and check valves disposed in the canals for controlling the flow of gas to the quenching gap are described in U.S. application Ser. No. 454,544, filed Mar. 25, 1974, entitled "Arc Quenching Arrangement." Each check valve in such an arrangement is disposed in a flow canal formed in a body of electrical insulation material. The quenching gas utilized is usually sulfur hexafluoride ($SF_6$), which also serves as an insulating medium.

Gas-flow type circuit breakers are preferred for use in high-voltage electrical installations for extinguishing large arc currents. Typically, several check valves and flow canals are provided in such circuit breakers. The gas flow canals may be configured in the shape of a ring canal having a plurality of spring vanes which function as check valves.

Generally speaking, such a gas-flow arc blasting arrangement is coupled to one of the electrodes of the circuit breaker in a positive, force-transmitting relationship. In one known gas-flow type circuit breaker, gas compression during separation of the electrodes of the breaker is limited by a gas overflow canal running parallel to the quenching gap of the apparatus. The overflow canal couples a high pressure space (in which the arc quenching gas is disposed) with a lower pressure area within the body of insulation material near the quenching gap and contains at least one pressure valve for controlling the flow of gas therethrough. The pressure valve is biased so that the quenching gap is bypassed and the pressure valve within the high pressure space in the housing is exceeded. If such an overpressure occurs, the arc-quenching gas flows directly through the overflow canal to the low pressure region within the insulation body and bypasses the quenching gap.

It has been discovered that the quenching capacity of the arrangement can be adversely affected if, during the time in which the arc to be extinguished decreases to a zero current flow, the heated arc-quenching gas must first be displaced from the space in each flow canal between the check valve and the quenching gap adjacent the electrodes of the apparatus subsequent to the pressure build-up within the breaker apparatus housing and after the opening of the check valve.

SUMMARY OF THE INVENTION

It is therefore an object of the present invention to overcome the aforementioned disadvantages of heretofore known arc-quenching arrangements and to provide an improved arc-quenching arrangement for a gas-flow type circuit breaker apparatus having an enhanced arc-quenching effect, particularly for arc currents of large magnitude.

These and other objects are achieved in a gas-flow type circuit breaker apparatus including a housing; a body of insulation material disposed within the housing and forming an arc-quenching gap therewithin; at least one gas flow canal disposed within the body of insulation material for directing a quenching gas from a space withing the housing to the vicinity of the quenching gap; fixed and movable electrical contacts disposed within the housing adjacent the quenching gap; and a check valve disposed in the flow canal for permitting the flow of the gas only from the housing space to the quenching gap. The improvement of the invention comprises the flow canal extending to and opening into the interior of the body of insulation material adjacent the quenching gap, and the disposition of the check valve at the end of the flow canal at the quenching gap.

A plurality of gas flow channels may be provided, if desired, or a single gas flow channel having an annular opening arranged concentrically with respect to the ends of the circuit breaker electrodes may be utilized instead. The gas flow canals of the apparatus are contained within the body of electrical insulation material, and the latter includes an annular opening, disposed concentrically with respect to the electrodes of the apparatus, which defines the quenching gap and forms a nozzle constriction which influences the flow of the arc-quenching gas. The gas flow canals are preferably designed so that they terminate immediately at the quenching gap formed by the nozzle constriction; at most, the flow canals terminate at a distance away from the gap which is not greater than the inside diameter of the quenching gap formed by the nozzle constriction.

The check valves utilized preferably comprise spring vanes fabricated of metal or electrical insulation material. The vanes may be partially or completely covered with a coating for protecting the check valves from damage by the arcs generated. In a preferred embodiment of the invention, the protective covering is formed by a circular slot machined into the body of insulation material. Also, the body of insulation material is preferably designed so that it forms a quenching chamber having a predetermined volume which is sealed from the space in which the gas is compressed within the housing. The quenching chamber within the body of insulation material comprises that area therewithin which is affected by the pressurized quenching gas and is disposed adjacent the quenching gap formed by the body of insulation material. The quenching chamber is coupled to the quenching gap by at least one flow canal or an annular gap.

The pressure of the quenching gas may be influenced by the size of the quenching volume during the extinguishment of large arc currents. Since the quenching gas utilized is heated by the arcs generated between the electrodes of the breaker and may be forced back into the quenching chamber, it is preferable to provide additional means for cooling, such as, for example, cooling fins or metallic honeycomb and screen-like structures fabricated of metal or plastic or metal partially coated with plastic. The gas flow canals are also preferably provided with an enlarged volume at least in the vicinity of the openings thereof into the interior space of the body of insulation material so that a large volume of gas is available for blasting the generated arcs in the vicinity of the check valves during the quenching process.

These and other features of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
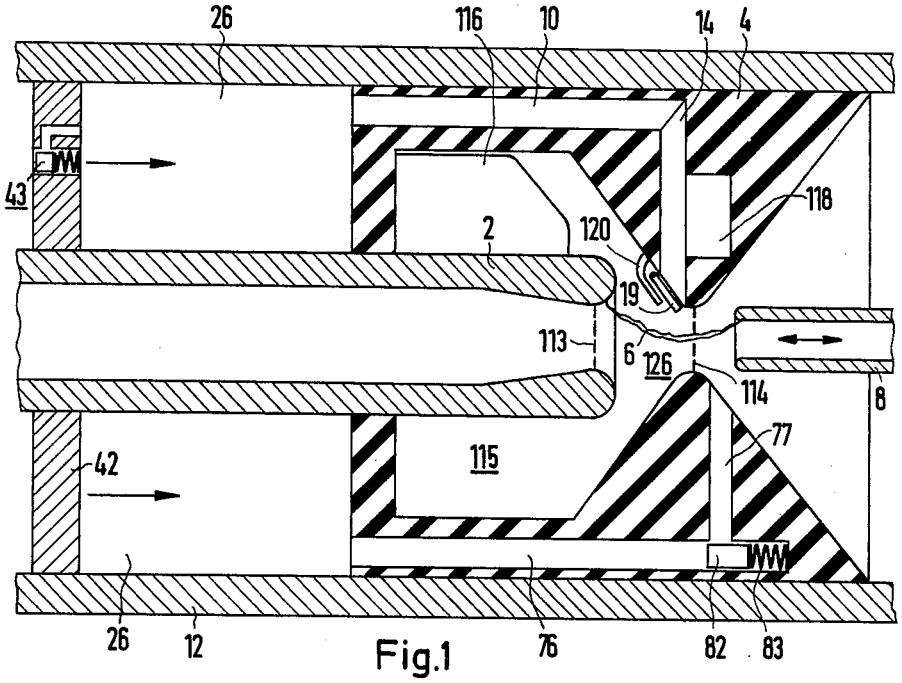
FIG. 1 is a longitudinal cross-sectional view of an improved arc-quenching arrangement constructed in accordance with the present invention.

Referring now to the drawings, and in particular to FIG. 1, there is shown a pair of fixed and movable electrical contacts or electrodes, designated 2 and 8, respectively, about which a body of electrical insulation material 4 and a housing 12 are concentrically disposed. The body of insulation material includes a gas supply canal formed by two channels 10 and 14, the latter of which terminates and opens into the interior space of the body of insulation material in the immediate vicinity of a nozzle-shaped constriction, i.e., at a quenching gap 126 formed between the electrodes.

A compression space 26 is provided within the housing in which an arc-quenching gas is pressurized. The pressure of the gas is varied by moving a movable rear wall 42 of the housing which functions as a blasting piston. Another check valve 43 is disposed in wall 42 for supplying quenching gas to space 26 when the circuit breaker is in its contact-closed condition. An overflow canal is provided in the body of insulation material in order to limit the maximum pressure of the compression space 26 adjoining the quenching process. The overflow canal comprises a pair of channels designated 76 and 77 in which an overpressure valve 82, biased by a valve spring 83, is disposed.

Stationary electrode 2 is hollow and is configured in the shape of a nozzle, the inside opening of which (illustrated by the dashed lines in FIG. 1) has a cross-sectional discharge area, designated 113, for removing the quenching gas injected adjacent the quenching gap 126 formed by the body of insulation material. A second cross-sectional discharge area 114 is formed by the body of insulation material and is configured as an aerodynamic acceleration nozzle, specifically a Laval nozzle. The body of insulation material and the stationary electrode 2, in combination, form a cavity within the body 4 which functions as a quenching chamber 115. Cooling fins 116 are preferably provided within the quenching chamber.

The check valve 19 is at the end of channel 14 and includes a covering 120 to protect the valve from the detrimental effects of the action of the generated arcs 6 to be extinguished. A recess 118 communicative with the channel is provided in the body of insulation material 4 in the region of channel 14 of the gas flow canal immediately preceding the check valve 19 thereof. This effectively provides an expansion of the cross-sectional area of the channel 14 immediately before the termination of the channel.

In operation of the invention, movable electrode 8 is disposed within hollow electrode 2 when the circuit breaker is in its contact-closed condition. The movable electrode may be configured as a hollow electrode, and is slidable within the nozzle-shaped aperture of electrode 2. The interior space of that aperture may, if desired, be equipped with a suitable electrical contact, such as, for example, an arrangement of contact fingers.

In the embodiment of the circuit breaker illustrated, electrode 8 may, if desired, be designed so that it can be moved with rear wall 42 and electrode 2, and the body of insulation material 4 as well as housing 12 may be designed as a stationary structural unit. In such an embodiment, movable electrode 8 would be directly coupled to wall 42 by means of a suitable mechanical linkage, not illustrated in the drawings.

Alternatively, electrode 2 may be fastened to the body of insulation material and may be moved within housing 12, which would then be stationary. In such an arrangement, electrode 8 and wall 42 are firmly coupled to housing 12.

During the interruption of a current flow of relatively small magnitudes, such as a few thousand amperes (e.g., 3,000 A), the arc-quenching gas, which is preferably sulfur hexafluoride ($SF_6$), flows from compression space 26 in housing 12 through channel 115 of the arrangement. The quenching gas further flows through the discharge cross-sectional areas 113 and 114 and quenches the generated arcs 6 flowing between electrodes 8 and 2 at the zero crossing of the current. In such situations, check valve 19 is opened during the entire quenching process and the flow of the quenching gas is only insignificantly affected by the generated arcs.

During the interruption of a larger current flow of, for example, 30,000 A and greater, the energy released by the generated arcs 6 between the cross-sectional areas 113 and 114 cannot be removed rapidly enough and a pressure build-up, with a corresponding pressure increase in the quenching chamber 115, occurs. If, during a predetermined period of time within a half-period of the current, the pressure in the quenching chamber 115 exceeds the pressure in the compression space 26, check valve 19 closes and prevents a reverse flow of the hot arc-quenching gas. If, however, as the current decreases in magnitude, the supply of power decreases and the pressure in quenching chamber 115 drops below the pressure level produced in compression space 26, or below the pressure threshold level of the overpressure valve 82, the flow of the quenching gas from compression space 26 to the quenching gap 126 begins again. Since fresh arc-quenching gas is supplied through channels 10 and 14 to the immediate vicinity of the nozzle constriction, the flow time to the constriction is small. The distance of the check valve 19 from the discharge cross-sectional area 114 of the constriction should, therefore, not be more than approximately the diameter of the cross-sectional area 115. The discharge opening of the quenching gas flow canal is, therefore, disposed in the immediate vicinity of the cross-sectional area 114 of the body of insulation material 4 within a distance therefrom in the axial direction towards quenching chamber 126 which is not greater than the diameter of the discharge cross-sectional area 114. Check valve 19 is preferably disposed immediately adjacent the nozzle constriction 114 so that when check valve 19 closes, heated gas cannot be stored in the flow channel 14 and need not be discharged first when valve 19 opens.

The quenching arrangement described above has the advantage that fresh arc-quenching gas is maintained within the flow canal in the immediate vicinity of the nozzle constriction of the body of insulation material and immediately flows out into the quenching gap when check valve 19 opens. Since only a few milliseconds are available after the pressure build-up phase to build up the flow of the quenching gas, it is important to shorten the flow path thereof to the quenching gap and the generated arc in any possible manner. The number of and cross-sectional areas of the flow channels 10 and 14 are preferably large compared to the sum of the discharge cross-sectional areas 113 and 114. In addition, by providing a recess 118 in flow channel 14 immediately preceding check valve 19, a larger volume of arc-quenching gas is stored in the channel and is ready to flow into the quenching gap when check valve 19 opens. It should be noted that the recess 118 illustrated in the drawings is merely schematic in design and may be of any suitable shape. In designing this region of the flow canal, it is important only to provide the necessary means for storing a volume of arc-quenching gas which is as large as possible immediately preceding the check valve 19 so that flow resistance is low and the quantity of gas available for quenching can be maintained at a relatively large volume.

Figure 2:
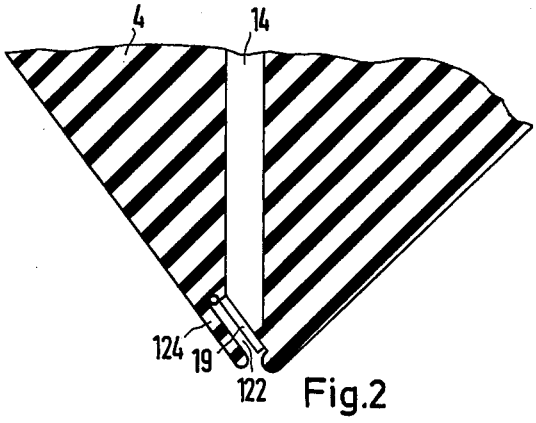
FIG. 2 is an enlarged, partial cross-sectional view of the arc-quenching arrangement of the invention schematically illustrating in detail one embodiment of the check valves of the invention.

FIG. 2 of the drawings illustrates in detail a particular embodiment of check valve 19. In this embodiment, flow channel 14 terminates in a slot 122 provided in the body of insulation material 4. Valve 19 is disposed at the end of the flow channel and a covering member 24 formed by slot 122 projects from the body of insulation material adjacent the check valve and protects the valve from the action of the generated arcs.

In the foregoing, the invention has been described with reference to specific exemplary embodiments thereof. It will, however, be evident that variations and modifications may be made thereunto without departing from the broader spirit and scope of the invention as set forth in the appended claims. The specification and drawings are, accordingly, to be regarded in an illustrative rather than in a restrictive sense.

What is claimed is:

1. In a gas-flow circuit breaker apparatus including a housing, a body of electrical insulation material disposed within said housing and forming an arc quenching gap therewithin, at least one gas flow canal disposed within said body of insulation material for directing a quenching gas from a space within said housing to the vicinity of said quenching gap, fixed and movable electrical contacts disposed within said housing adjacent said quenching gap, and a check valve disposed in said flow canal for permitting the flow of said gas only from said gap, the improvement comprising said flow canal extending to and opening adjacent said quenching gap, and said check valve being disposed at the end of said flow canal at said quenching gap.

2. The apparatus recited in claim 1, wherein said body of insulation material is annular in shape and includes an interior opening configured as a gas flow nozzle, and wherein said flow canal extends to and opens into said interior opening of said body of insulation material at a distance from said gas flow nozzle which is no greater than the diameter of said gas flow nozzle.

3. The apparatus recited in claim 1, wherein said body of insulation material includes a plurality of said gas flow canals.

4. The apparatus recited in claim 1, wherein said check valves comprise spring vanes.

5. The apparatus recited in claim 4, further comprising a covering member formed by said body of insulation material and disposed adjacent said check valve for protecting said valve from arcs generated during separation of said electrical contacts.

6. The apparatus recited in claim 5, wherein said covering member is formed by a slot disposed in said body of insulation material adjacent said check valve.

7. The apparatus recited in claim 1, wherein said body of insulation material includes a quenching chamber disposed therein which is communicative with said quenching gap.

8. The apparatus recited in claim 7, further comprising means, disposed in said quenching chamber, for cooling said quenching gas.

9. The apparatus recited in claim 8, wherein said means for cooling comprises cooling fins.

10. The apparatus recited in claim 3, further comprising a recess communicative with said flow canal and disposed in said body of insulation material adjacent said flow canal immediately preceding said check valve.

11. The apparatus recited in claim 3, wherein said body of insulation material is annular in shape and includes a gas flow nozzle formed therewithin and a discharge outlet for said quenching gas, and wherein at least one of said electrical contacts is hollow and has the end thereof configured as a gas flow nozzle for forming another gas discharge outlet for said quenching gas, the total cross-sectional area of said flow canal being substantially larger than the sum of said discharge outlets provided in said body of insulation material of said hollow electrical contact.

* * * * *